United States Patent [19]

Kaufmann et al.

[11] 4,232,713

[45] Nov. 11, 1980

[54] HEDDLE FRAME NOSE GUIDE

[75] Inventors: Frank H. Kaufmann; Charles F. Kramer, both of Greenville, S.C.

[73] Assignee: Steel Heddle Manufacturing Company, Greenville, S.C.

[21] Appl. No.: 32,656

[22] Filed: Apr. 23, 1979

[51] Int. Cl.[3] ..... D03C 9/06
[52] U.S. Cl. ..... 139/91
[58] Field of Search ..... 139/91, 92

[56] References Cited

U.S. PATENT DOCUMENTS

| | | | |
|---|---|---|---|
| 2,645,251 | 7/1953 | Haenny | 139/92 |
| 3,417,787 | 9/1966 | Kaufmann | 139/91 |
| 3,970,114 | 7/1976 | Baumann | 139/91 |

*Primary Examiner*—Henry Jaudon
*Attorney, Agent, or Firm*—Bailey, Dority & Flint

[57] ABSTRACT

A nose guide device is disclosed for a heddle frame of a weaving loom which operates as a guide to maintain adjacent heddle frames separated during shedding wherein ends of a front and back side of the device are split and uniquely constructed to interlock with an open slot in a frame slat of the heddle frame for quick and convenient installation and removal.

4 Claims, 4 Drawing Figures

HEDDLE FRAME NOSE GUIDE

BACKGROUND OF THE INVENTION

The invention relates to a weaving loom harness and, more particularly, to guide devices attached to the top and bottom frame slats of a heddle frame having a rounded nose portion which protects the frames and keeps adjacent heddle frames from striking one another during shedding operations in which closely adjacent parallel frames reciprocate in alternate up and down movements.

Heretofore, nose guide devices have been provided which have been attached to the frame slats of the heddle frames in numerous ways. However, with the advent of extruded metal frame slats such as aluminum, attachment of the nose guide devices by penetrating means such as screws has not been desirable due to the thinness of the slats. Furthermore, a nose guide device which is easily and quickly installed and removed is desirable for replacing nose guide devices which have become broken or damaged. Attachment is further complicated since to install the nose guide device over an end of the frame slat requires disassembly of the heddle frame and, heretofore, attempts have been made to construct the nose guide device as two pieces whereby they may be snapped together over the frame slat eliminating the need for disassembly.

One prior device is disclosed in U.S. Pat. No. 3,901,282 wherein a nose guide device is combined with a heddle rod holder in the form of a two piece construction which snaps together over the frame slat or rail of a heddle frame. However, the problem is encountered that loose parts are difficult to assemble during installation and/or a tool must be used to effect the installation or removal of the device.

Accordingly, an important object of the present invention is to provide a nose guide device which may be installed and removed from a frame slat of a heddle frame in a quick and easy manner without the use of tools.

Another important object of the present invention is the provision of a nose guide device which may be readily attached to a frame slat of a heddle frame in a generally one piece configuration.

Still another important object of the present invention is the provision of a nose guide device which includes a tapered nose portion at one end thereof and a split end portion at an opposing end thereof whereby the split ends may be spread apart for straddling and interlocking with the frame slat in a unique manner.

Still another important object of the present invention is the provision of a nose guide device which may be easily attached to a heddle frame slat without disassembly of the heddle frame and which may be set in a fixed position lengthwise on the heddle frame slat.

Yet another important object of the present invention is to provide a nose guide device for a heddle frame having improved wear characteristics.

SUMMARY OF THE INVENTION

It has been found that a nose guide device can be had according to the invention which may be easily and quickly installed and removed from a heddle frame slat by providing a pair of split flexible end portions which may be bent away from one another and receive the frame slat therethrough into an open transverse slot and which flex back together and interlock in a longitudinal groove formed in the frame slat.

BRIEF DESCRIPTION OF THE DRAWING

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein.

DESCRIPTION OF A PREFERRED EMBODIMENT

Figure 1:
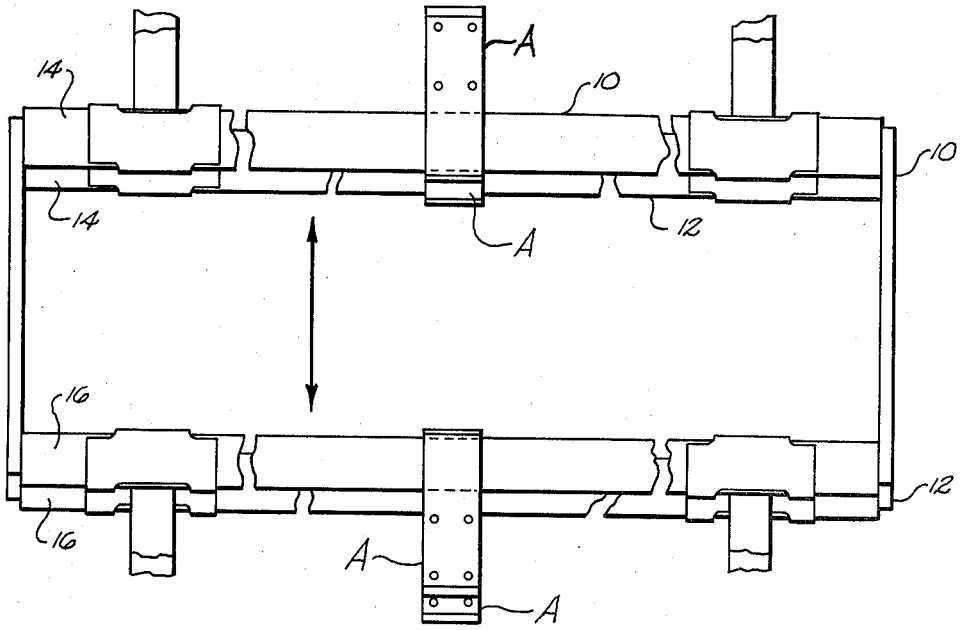
FIG. 1 is a front elevational view illustrating a pair of heddle frames with the heddles and supporting rods omitted.

The invention relates generally to a loom harness of a weaving loom wherein warp yarns are held in heddles supported on a heddle frame and only that portion of a weaving loom is illustrated as is necessary for an understanding of the invention. Accordingly, only the heddle frame itself is illustrated in the drawing with the heddles and supporting rods omitted.

The drawing illustrates a nose guide device A for maintaining adjacent heddle frames 10 and 12 of a weaving loom separated during shedding wherein each heddle frame includes respective top and bottom frame slats 14 and 16 having a longitudinal open-top groove 18 formed along a side edge thereof. The nose guide device includes spaced elongated front and back sides B and C and side edge means D joining and spacing the front and back sides. The side edge means terminates short of the length of the front and back sides to define opposing open side edge portions **19*a* and 19*b*** and a corresponding open transverse slot E extending therebetween for receiving a frame slat. Biasing means F carried intermediate the front and back sides extends into the open transverse slot for engaging the frame slat when fully received therein.

One end of the front and back sides terminates in a tapered end portion 20 defining a nose for separating adjacent heddle frames. The front and back sides are split at an opposing end thereof defining first and second free end portions 22 and 24 bendable away from one another for straddling and receiving the frame slat into the transverse slot E against the biasing means. A hook portion G is formed adjacent the ends of the first and second free end portions for fully engaging within the open-top groove of the frame slat when the frame slat is received in said transverse slot and urged upwards by the biasing means.

In the preferred form, the nose guide device A is constructed of any suitable abrasion resistant plastic and, as illustrated, may be constructed as two halves which snap together prior to installation, and attach to the frame slat as one piece, or it may be molded in a one-piece construction. Either of which provides the quick and easy manner of attachment. The snap construction is provided by male snap connectors 29*a* and corresponding female snap connectors 29*b* formed on respective front and back sides.

The hook portion G adjacent the ends of the free end portions 24 and 26 is provided in the form of downwardly extending lip flanges 26 and 28, respectively, extended parallel to the front and back sides and defining a space therebetween which receives an upper edge of the open top groove 18 when engaged therein.

The side edge means D includes opposing solid sides 30 integrally bridging the front and back sides defining a bottom portion of the transverse groove at 32 and extending longitudinally to the tapered nose portion 20 whereat the sides 30 correspond to the taper of the front and back sides as illustrated.

Figure 2:
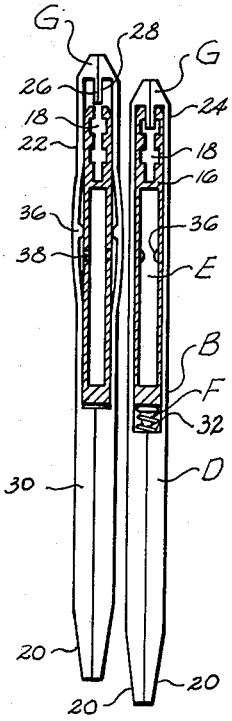
FIG. 2 is a side elevation illustrating a nose guide device constructed according to the invention during attachment and attached to a heddle frame slat illustrated in section.
Figure 3:
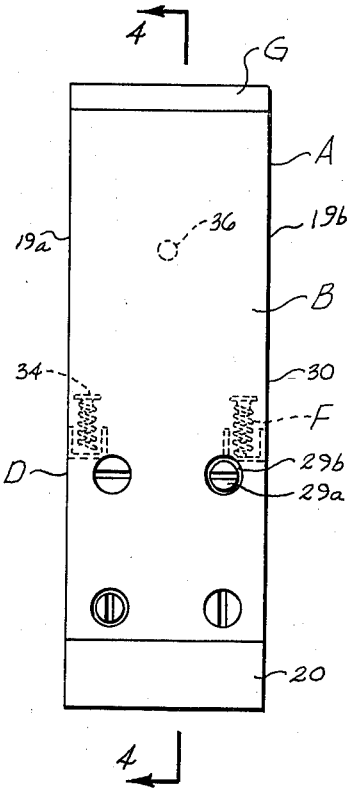
FIG. 3 is a front elevational view of a nose guide device constructed according to the invention.
Figure 4:
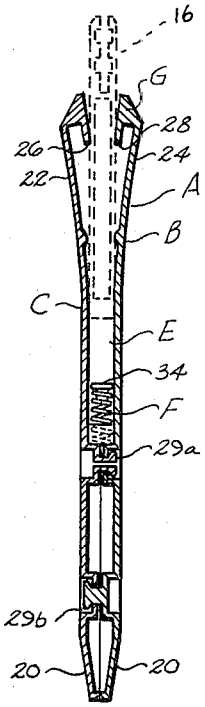
FIG. 4 is a sectional view taken along line 4—4 with the split ends of the nose guide device being separated for receiving a frame slat of a heddle frame.

As illustrated, the biasing means F includes a spring loaded plunger 34 carried between the front and back sides of the nose guide device in a molded compartment formed therein wherein engagement of the frame slat in the transverse slot E depresses the spring-loaded plunger resulting in an upward biasing force thereagainst. In use, with the free end portions 22 and 24 separated slightly by manual manipulation, the frame slat may be received therebetween and pressed into the slot E against the spring-loaded plunger 34 compressing the plunger and spring until the interlocking lip flanges 26 and 28 are directly over the open top slot 18 as best seen in FIG. 2. The spring-loaded plunger is then released by letting go of the nose guide or frame slat such that the interlocking lip flanges are engaged in the open top of the slot 18 in a locking manner. Biasing means F not only aids in retaining hook portion G in the groove 18, but also takes up play between the nose guide and frame slat during operation resulting in improved wear characteristics.

The nose guide device A includes a profiled element 36 formed on at least one of the front and back sides so as to protrude into the transverse slot E and be receivable in a dimple 38 formed in a corresponding side of the frame slat whereby the nose guide device is retained in a set position lengthwise along the frame slat. The rounded shape of the profiled elements enables the nose guide to be unlocked from its set position by slight lateral force.

After the hook portions interlock in the open top groove, the nose guide device may be moved along the length of the frame slat until the profiled element 36 is received and locked in the corresponding dimple 38 whereby the lengthwise position of the nose guide device on the frame slat is set. In this manner, the nose guide devices on adjacent heddle frames may be set in position where they strike one another eliminating wear on the metal frame slat as best seen in FIG. 1.

Thus, it can be seen that an advantageous construction for a nose guide device may be had whereby split free ends of the nose guide device may be separated enabling the nose guide to slide over a frame slat in a one-piece construction wherein the free ends include hook portions which lock in the frame slat groove by means of biasing means providing the additional result that during shedding operation, free play is reduced between the nose guide and frame slat providing improved wear characteristics. The construction also affords use of the nose guide device in a universal fashion on a variety of frame slat sizes.

While a preferred embodiment of the invention has been described using specific terms, such description is for illustrative purposes only, and it is to be understood that changes and variations may be made without departing from the spirit or scope of the following claims.

What is claimed is:

1. A nose guide device for maintaining adjacent heddle frames of a weaving loom separated during shedding wherein each heddle frame includes top and bottom frame slats having a longitudinal open-top groove formed along a side edge thereof, said nose guide device comprising:

spaced elongated front and back sides;

side edge means joining and spacing said front and back sides;

said side edge means terminating short of the length of said front and back sides defining opposing open side edge portions and a corresponding open transverse slot extending therebetween for receiving a frame slat;

biasing means carried intermediate said front and back sides extending into said open transverse slot for engaging said frame slat;

one end of said front and back sides terminating in a tapered end portion defining a nose for separating adjacent heddle frames;

said front and back sides being split from one another at an opposing end thereof defining first and second free end portions bendable away from one another for straddling and receiving said frame slat therethrough to engage said biasing means; and opposing hook portions formed adjacent the ends of said first and second free end portions for engaging in said open-top groove of said frame slat when said frame slat is received in said transverse slot and urged outwardly by said biasing means.

2. The device of claim 1 including a profiled element formed on the interior side of at least one of said front and back sides protruding into said transverse slot receivable in dimple means formed in a corresponding side of the frame slat for retaining said nose guide device in a desired position lengthwise along the frame slat.

3. The device of claim 1 wherein said side edge means include generally solid sides integrally bridging said front and back sides.

4. The device of claim 1 wherein said hook portion includes flange means extending downwardly generally parallel to said front and back sides defining a space therebetween receiving an edge of said open-top slot when engaged therein.

* * * * *